US009502166B2

(12) United States Patent
Jeong et al.

(10) Patent No.: US 9,502,166 B2
(45) Date of Patent: Nov. 22, 2016

(54) VARIABLE-CYCLE PERMANENT-MAGNET UNDULATOR

(71) Applicant: KOREA ATOMIC ENERGY RESEARCH INSTITUTE, Daejeon (KR)

(72) Inventors: Young Uk Jeong, Daejeon (KR); Ki Tae Lee, Daejeon (KR); Seong Hee Park, Daejeon (KR); Shang In Shin, Daejeon (KR); Kyuha Jang, Daejeon (KR); Jeong Ho Moon, Daejeon (KR); Nikolay Vinokurov, Daejeon (KR)

(73) Assignee: KOREA ATOMIC ENERGY RESEARCH INSTITUTE (KR)

( * ) Notice: Subject to any disclaimer, the term of this patent is extended or adjusted under 35 U.S.C. 154(b) by 124 days.

(21) Appl. No.: 14/423,230

(22) PCT Filed: Dec. 26, 2012

(86) PCT No.: PCT/KR2012/011494
§ 371 (c)(1),
(2) Date: Feb. 23, 2015

(87) PCT Pub. No.: WO2014/030810
PCT Pub. Date: Feb. 27, 2014

(65) Prior Publication Data

US 2015/0255201 A1 Sep. 10, 2015

(30) Foreign Application Priority Data

Aug. 24, 2012 (KR) ..... 10-2012-0093102

(51) Int. Cl.
*H01F 7/02* (2006.01)
*H05H 7/04* (2006.01)
*H01F 1/053* (2006.01)

(52) U.S. Cl.
CPC ..... *H01F 7/0221* (2013.01); *H01F 1/053* (2013.01); *H05H 7/04* (2013.01)

(58) Field of Classification Search
CPC ..... H05H 7/04; H05H 2007/041–2007/046; H01F 7/0278
See application file for complete search history.

(56) References Cited

U.S. PATENT DOCUMENTS 4,355,236 A * 10/1982 Holsinger ..... H05H 7/04 250/396 ML
4,731,598 A * 3/1988 Clarke ..... H01F 7/0278 315/5.35

(Continued)

FOREIGN PATENT DOCUMENTS

JP 06275399 9/1994
JP 07296999 11/1995

(Continued)

OTHER PUBLICATIONS

International Search Report—PCT/KR2012/011494 dated Apr. 30, 2013.

(Continued)

*Primary Examiner* — Alexander Talpalatski
(74) *Attorney, Agent, or Firm* — Cantor Colburn LLP

(57) ABSTRACT

A variable-period permanent-magnet undulator which is applicable not only to a planar undulator but also to a helical undulator, in which permanent-magnets and ferromagnetic substances are alternately arranged, and the ferromagnetic substance interposed between the permanent-magnets is saturated to thus enable the magnets to be effectively spaced apart from each other by the repulsive force between the permanent-magnets, thereby adjusting the period of the magnetic field in an easy and precise manner.

19 Claims, 10 Drawing Sheets

(56) References Cited

U.S. PATENT DOCUMENTS 4,764,743 A * 8/1988 Leupold ..... H01F 7/0278 335/212
5,014,028 A * 5/1991 Leupold ..... H01F 7/0278 315/3.5
5,019,863 A * 5/1991 Quimby ..... H05H 7/04 315/5.35
RE33,736 E * 11/1991 Clarke ..... H01F 7/0278 315/5.35
5,714,850 A * 2/1998 Kitamura ..... H05H 7/04 315/5.35
5,945,899 A * 8/1999 Leupold ..... H01F 7/0278 335/210
6,573,817 B2 * 6/2003 Gottschalk ..... H05H 7/04 335/302
6,858,998 B1 * 2/2005 Shenoy ..... H05H 13/04 315/501
7,872,555 B2 * 1/2011 Kitamura ..... H05H 7/04 315/501

FOREIGN PATENT DOCUMENTS

| | | |
|---|---|---|
| JP | 08203697 | 8/1996 |
| JP | 08222400 | 8/1996 |
| JP | 2003142300 | 5/2003 |

OTHER PUBLICATIONS

N. A. Vinokurov et al., Variable-period permanent magnet undulators, American Physical Society, 2011, pp. 1-7.

* cited by examiner (A)

(B)

(A)

(B)

(A)

(B)

Peak magnetic field on axis = 1.07 T (A)

(B)

VARIABLE-CYCLE PERMANENT-MAGNET UNDULATOR

TECHNICAL FIELD

The present invention relates to a variable-period permanent-magnet undulator.

An undulator is a periodic magnetic or electric structure, i.e., a device for generating light from electron beams in a free electron laser or synchrotron accelerator. When kinetic energy of an electron beam has a relative speed that is close to the speed of light, the magnetic undulator is used. More particularly, the undulator is formed to have a magnetic field that periodically changes in a progress direction of electrons to radiate light having a specific wavelength. Here, a permanent magnet or electromagnet may be periodically disposed to realize the magnetic field. FIG. 1 is a schematic view of a configuration of a general undulator. (A) in FIG. 1 is a view of a planar undulator in which a magnetic field changes in direction within a plan, and (B) in FIG. 1 is a view of a helical undulator in which a magnetic field changes in a helical direction (in (A) of FIG. 1, a distance between magnets is exaggeratedly somewhat so as to well express the direction of the magnetic field). As illustrated in (A) of FIG. 1, a motion in which electrons are progressed in a meanderingly bent shape along the electric field is called a wiggling motion. This may determine a polarization direction of radiation. That is, the radiation generated by the planar undulator may become to linear polarization, the radiation generated by the helical undulator may become to circular polarization.

A wavelength λ of the radiation generated in the undulator may be expressed as the following Mathematical Equation 1. Where, a reference symbol γ is a Lorentz factor that expresses energy of an electron beam, a reference symbol λu is a period of an undulator magnetic field, and a reference symbol Bu is strength of the undulator magnetic field on axis.

$$\lambda = \frac{\lambda_u}{2\gamma^2}(1 + K^2),\ K \propto B_u\lambda_u \qquad \text{[Mathematical Equation 1]}$$

As known from Mathematical Equation 1, a wavelength of the radiation generated from the undulator is determined by energy of the electron beam and undulator characteristics. In the determination of the desired wavelength of the radiation, a wavelength band of radiation such as terahertz, infrared rays, visible light, ultraviolet rays, and X-rays may be determined first according to the energy of the electron beam, and then the undulator characteristics may be adjusted accurately to finely adjust the wavelength to a desired wavelength. As shown in Mathematical Equation 1, since the radiation changes in wavelength according to the period λu of the undulator magnetic field and the strength Bu of the undulator magnetic field, it is seen that the period or strength of the undulator magnetic field is adequately adjusted to adjust the wavelength of the radiation.

Here, as illustrated in FIG. 1, the period of the magnetic field may change by physically adjusting a distance between the magnets constituting the undulator. Thus, it may be easy to adjust the strength of the magnetic field than the period of the magnetic field. As a result, the existing undulator may generally adjust the strength of the magnetic field to adjust the wavelength of the radiation. In case of the undulator using the permanent magnets, a gap space of the undulator may change in size to easily adjust the strength of the magnetic field. In case of the undulator using the electromagnet, current may change to easily adjust the strength of the magnetic field.

BACKGROUND ART

However, the structure in which the magnetic field is adjusted in strength to adjust the wavelength of the radiation may have following several problems.

As illustrated in (A) of FIG. 1, in case of the planar undulator, the magnetic field may be easily adjusted by using the permanent magnet or electromagnet. When the permanent magnet is used, the array of the permanent magnets may be physically spared or narrowed in the vertical direction to change the size of the gap space of the undulator. In case of the planar undulator, even though the permanent magnet is used, the gap space of the undulator may easily change in size. However, in case of the helical undulator, unlike the planar undulator, it may be structurally difficult to adjust the gap between the magnets (see (B) in FIG. 1).

When the electromagnet is used, the mechanical movement may not be necessary at all, and thus, only the current may be adjusted as described above. However, since the magnetic field of the electromagnet is a relatively weak when compared to that of the permanent magnet (thus, since large current has to be applied to form a strong magnetic field that is similar to that of the permanent magnet, it is impossible to form the strong magnetic field at room temperature by using a wire having a small diameter), the radiation may not be effectively generated as well known. In case of the helical undulator, since the gap is hard to be adjusted in size to adjust the strength of the magnetic field, thereby adjusting the wavelength of the radiation as described above, the electromagnet has to be used. Thus, it may be difficult to obtain the radiation having a desired high output power with a compact size because of the small-sized wire.

In addition, in the method for adjusting the wavelength of the radiation by adjusting the strength of the magnetic field, the output power of the radiation as well as the wavelength of the radiation may change.

Due to these several problems, studies about the undulator structure in which the magnetic field change in period, but does not change in strength, to adjust the wavelength of the radiation have been continuously carried out. FIG. 2 illustrates undulator technologies in which a magnetic field is adjusted in period according to the related art.

An undulator including a mechanical link device for adjusting a distance between magnets is disclosed in U.S. Pat. No. 6,858,998 ("Variable-period undulators for synchrotron radiation", 2005 Feb. 22, hereinafter, referred to as a prior art 1). In the prior art 1, the distance between the magnets may change, i.e., the magnetic field may be adjusted in period to adjust a wavelength of radiation. Thus, since it is possible to use a permanent magnet, the above-described problems when the electromagnet is used may be solved. (A) of FIG. 2 is a schematic view of the link device according to the prior art 1. As illustrated in (A) of FIG. 2, an angle between links of the link device may be adjusted to adjust the distance between the magnets. However, in case of the prior art 1, since it is very difficult to realize fine movement due to the structural characteristics thereof, it may be very difficult to precisely adjust the distance between the magnets. Thus, it may be difficult to finely adjust the wavelength of the radiation. In addition, the prior art 1 relates to a planar undulator. This structure may not be applied to the helical undulator as it is and also be very difficult in design change to be applied to the helical undulator.

A variable-period structure in new viewpoints for the planar undulator is disclosed in the paper "Variable-Period Permanent Magnet Undulators" (Vinokurov, N. A. et al., 2011 Physical Review Special Topics-Accelerators and Beams 14(4), art. no040701, hereinafter, referred to as a prior art 2). (B) of FIG. 2 illustrates a structure and principle of the undulator disclosed in the prior art 2. In the prior art 2, permanent magnets and ferromagnetic materials each of which has a size less than that of each of the permanent magnets are alternately disposed. Here, the permanent magnets may be magnetized parallel to a progress direction of an array of the permanent magnets. Here, the permanent magnets may be alternately magnetized in the progress direction of the array of the permanent magnets so that the magnetized directions of the upper and lower arrays are symmetrical to each other.

When disposed as described above, the ferromagnetic materials may generate strong magnetic lines in an upward or downward direction by concentrating the magnetic fields generated from the adjacent permanent magnets. Here, the magnetic line formed on the ferromagnetic material may have a shape to allow a central line between two permanent magnets to form a symmetrical central line as illustrated in the enlarged view of (B) in FIG. 2. Here, in the prior art 2, as illustrated in the enlarged view of (A) in FIG. 2, the ferromagnetic materials are separated from each other with respect to the symmetrical central line. As a result, a repulsive force may be generated between the two separated ferromagnetic materials. Thus, a compressive force may be physically applied only in one direction from the outside to easily adjust the period of the magnetic field due to the repulsive force acting between the ferromagnetic materials.

However, it may also be impossible to apply the structure of the prior art 2 to the helical undulator. In case of the helical undulator, the pair of planar undulators has to be vertically disposed to cross each other as illustrated in (B) of FIG. 2, like the planar undulator illustrated in (b) of FIG. 2. Here, in cross-sections in an axis direction of the helical undulator, the arrangements of [the ferromagnetic materials in a vertical direction/the permanent magnets in a horizontal direction] or [the permanent magnets in a vertical direction/the ferromagnetic materials in a horizontal direction] are realized on the same plane. Thus, if the ferromagnetic materials are cut at a central position between the permanent magnets, the permanent magnet disposed in a direction perpendicular to the ferromagnetic material on the same plane has to be cut. However, if the permanent magnet is cut, the permanent magnet may be formed only as two permanent magnets to generate an attractive force therebetween. That is, since the attractive force is applied between the separated permanent magnets even though the repulsive force is applied between the separated ferromagnetic materials, it may be impossible to effectively spread the distance between the magnets. As described above, the structure of the prior art 2 may be optimized for the planar undulator, but may not be applied to the helical undulator.

PRIOR ART DOCUMENTS

Patent Documents

1. U.S. Pat. No. 6,858,998 ("Variable-Period Undulators for Synchrotron Radiation", 2005 Feb. 22)

Non-Patent Documents

1. Vinokurov, N. A. et al., "Variable-Period Permanent Magnet Undulators", 2011 Physical Review Special Topics-Accelerators and Beams 14(4), art. no040701

DISCLOSURE OF THE INVENTION

Technical Problem

Therefore, to solve the above-described problems, the objective of the prevent invention is to provide a variable-period permanent-magnet undulator that is capable of being applied to a helical undulator as well to a planar undulator. In more detail, the objective of the present invention is to provide a variable-period permanent-magnet undulator that is capable of easily precisely adjusting a period of a magnetic field through a structure in which a distance between magnets is effectively spared by a repulsive force between permanent magnets in the undulator in which permanent magnets and ferromagnetic substances are alternately arranged.

Technical Solution

To achieve the above-described objectives, a variable-period permanent-magnet undulator according to the present invention includes: permanent magnets 111 and ferromagnetic substances 112, which are alternately arranged to form at least a pair of arrays that are spaced apart from each other, wherein the permanent magnets 111 are magnetized in a direction parallel to an extension direction of each of the arrays of the permanent magnets 111 and the ferromagnetic substances 112, and each of the ferromagnetic substances 112 disposed between the pair of permanent magnets 111 is saturated in magnetic flux by magnetic fields generated from the pair of permanent magnets 111 adjacent to each other so that a distance between each of the permanent magnets 111 and the ferromagnetic substance 112 varies by a repulsive force between the permanent magnets 111.

Here, the undulator may be disposed so that the pair of permanent magnets 111 adjacent to each other in the extension direction of the array of the permanent magnet 111 and the ferromagnetic substance 112 are magnetized in directions opposite to each other, and the pair of permanent magnets 111 adjacent to each other in a spaced direction between the arrays of the permanent magnets 111 and the ferromagnetic substances 112 are magnetized in directions opposite to each other.

Also, in the undulator 100, the permanent magnet 111 may have an area greater than that of the ferromagnetic substance 112.

Also, the undulator 100 may include a planar undulator constituted by the pair of arrays of the permanent magnets and the ferromagnetic substances or a helical undulator constituted by two pair of arrays of the permanent magnets and the ferromagnetic substances, which are disposed perpendicular to each other on the coaxial circle.

Also, the permanent magnet 111 may be formed of a rare-earth-based permanent magnet material and may include Nd—Fe—B permanent magnets or samarium cobalt-based permanent magnets.

Also, the ferromagnetic substance 112 may be formed of at least one material selected from pure steel, low-carbon steel, and vanadium permenduer.

Also, when an axial center of the arrays of the permanent magnet 111 and the ferromagnetic substance 112 is defined as a central point, the extension direction of the array of the permanent magnet and the ferromagnetic substance is defined as a first direction, and two directions perpendicular to the first direction are respectively defined as second and third directions, the undulator may include: a plurality of magnetic parts 110 including at least one of the pair of permanent magnets 111 and the pair of ferromagnetic substances 112; a plurality of support plates 120 disposed in a direction perpendicular to the first direction to fixedly support the magnetic parts, the plurality of support plates having a through-hole that defines a passage, through which electron beams pass, in the central point and a plurality of guide unit through-holes and being formed of a nonmagnetic material; a plurality of guide units 130 extending in a direction parallel to the first direction to pass through the guide unit through-holes of the plurality of support plates 120, the plurality of guide units 130 being formed of a nonmagnetic material; and a linear transfer unit 150 supporting both ends of the array of the permanent magnet and the ferromagnetic substance, which is constituted by the magnetic parts 110 and the support plates 120, in the first direction, the linear transfer unit 150 having a length that varies in the first direction and applying a compressive force to the permanent magnet and the ferromagnetic substance in the first direction to adjust a distance between the magnetic parts 110.

Here, in the undulator 100, the magnetic parts 110 may include a pair of permanent magnets 111 that are disposed symmetrical to each other in a direction perpendicular to the first direction with respect to of the central point and are magnetized in directions opposite to each other and a pair of ferromagnetic substances 112 that are disposed symmetrical to each other in a direction perpendicular to the first direction and the arrangement direction of the pair of permanent magnets 111 of the central point), four magnetic parts 110 may be disposed in one period to form a helical undulator, when the four magnetic parts 110 are successively defined as a first magnetic part 110, a second magnetic part 110, a third magnetic part 110, and a fourth magnetic part 110, the second magnetic part 110 may rotate at an angle of about 90° in a predetermined rotation direction with respect to the first magnetic part 110 so that the permanent magnet 111 of the first magnetic part 110 and the ferromagnetic substance 112 of the second magnetic part 110 and the ferromagnetic substance 112 of the first magnetic part 110 and the permanent magnet 111 of the second magnetic part 110 face each other, the third magnetic part 110 may further rotate at an angle of about 90° in the same rotation direction with respect to the second magnetic part 110 so that the permanent magnet 111 of the second magnetic part 110 and the ferromagnetic substance 112 of the third magnetic part 110 and the ferromagnetic substance 112 of the second magnetic part 110 and the permanent magnet 111 of the third magnetic part 110 face each other, the fourth magnetic part 110 may further rotate at an angle of about 90° in the same rotation direction with respect to the third magnetic part 110 so that the permanent magnet 111 of the third magnetic part 110 and the ferromagnetic substance 112 of the fourth magnetic part 110 and the ferromagnetic substance 112 of the third magnetic part 110 and the permanent magnet 111 of the fourth magnetic part 110 face each other, and the permanent magnets 111 of the first to fourth magnetic parts 110 may be magnetized in a direction that successively rotates at an angle of about 90° in the rotation direction. Here, the rotation direction may be a clockwise direction or counterclockwise direction through the first direction of the axis.

Also, in the undulator, the magnetic parts 110 may include two kinds of parts including a pair of permanent magnets 111 that are disposed symmetrical to each other in a direction perpendicular to the first direction with respect to of the central point and are magnetized in directions opposite to each other and a pair of ferromagnetic substances 112 that are disposed symmetrical to each other in a direction parallel to the arrangement direction of the pair of permanent magnets 111 with respect to the first direction of the central point, four magnetic parts 110 may be disposed in one period to form a planar undulator, when the four magnetic parts 110 are successively defined as a first magnetic part 110, a second magnetic part 110, a third magnetic part 110, and a fourth magnetic part 110, the first and third magnetic parts 110 may correspond to permanent magnet magnetic parts, and the second and fourth magnetic parts 110 may correspond to ferromagnetic substance magnetic parts, and the permanent magnets 111 of the first and third magnetic parts 110 may be magnetized in opposite directions that symmetrical to each other.

Also, the linear transfer unit 150 may include: a frame 155; a fixed plate 151 fixed to one end of the array of the permanent magnet 111 and the ferromagnetic substance 112 of the frame 155; and a movable plate 152 disposed on the other end of the array of the permanent magnet 111 and the ferromagnetic substance 112, wherein the other end of the array of the permanent magnet 111 and the ferromagnetic substance 112 may be pushed by the movable plate 152 to apply the compressive force, and the movable plate 152 may linearly move in the first direction.

Also, each of the support plates 120 may be formed of a material selected from aluminum, an aluminum alloy, copper, and a copper alloy.

Also, each of the guide units 130 may be formed of a material selected from aluminum, an aluminum alloy, copper, and a copper alloy. Also, the guide unit through-holes 121 may be disposed symmetrical to each other with respect to the central point. Also, a bearing for reducing a friction force against each of the guide units 130 may be disposed in each of the guide unit through-holes 121.

Also, the undulator 100 may further include a plurality of elastic units 140 disposed between the support plates 120 to generate an elastic force in a direction opposite to the compressive force that is applied by the linear transfer unit 150. Also, in the undulator 100, a plurality of elastic unit through-holes 122 are further defined in the support plates 120, wherein each of the elastic units 140 may include a central rod 142 formed of a nonmagnetic material and extending parallel to the first direction to pass through each of the elastic unit through-holes 122 of the plurality of support plates 120 and a spring coil 141 disposed between the support plates 120 and fitted into the central rod 142.

Here, the central rod 142 may be formed of a material selected from aluminum, an aluminum alloy, copper, and a copper alloy. Also, the elastic unit through-holes 122 may be symmetrically disposed with respect to the central point.

Advantageous Effects

According to the present invention, the undulator may be adjusted in period, but not in strength of the magnetic field, to more stably adjust the wavelength of the radiation. According to the undulator on the related art, the magnetic field may change in strength to adjust the wavelength of the radiation. Thus, when the magnetic field strength changes, the radiation may change in output power. However, according to the present invention, since the magnetic field varies in period and the output power of the radiation may not be affected by the variation of the undulator period, the radiation may be adjusted in wavelength by the desired degree while maintaining the output power of the radiation.

Also, according to the present invention, since the magnetic field is generated by using the permanent magnets, the sufficient strong magnetic field may be generated without the power consumption.

Furthermore, the variable-period structure developed according to the related art may be applied to only the planar undulator, but not be applied to the helical undulator. However, according to the present invention, this variable-period structure may be applied to the helical undulator to very easily adjust the period of the magnetic field. Also, this simplified structure in which the magnetic field period varies may significantly reduce a volume of the device in itself. In addition, due to the simplified variable-period structure, the period may be easily and precisely adjusted to precisely adjust the wavelength by the desired degree.

DESCRIPTION OF SYMBOLS

Figure 1:
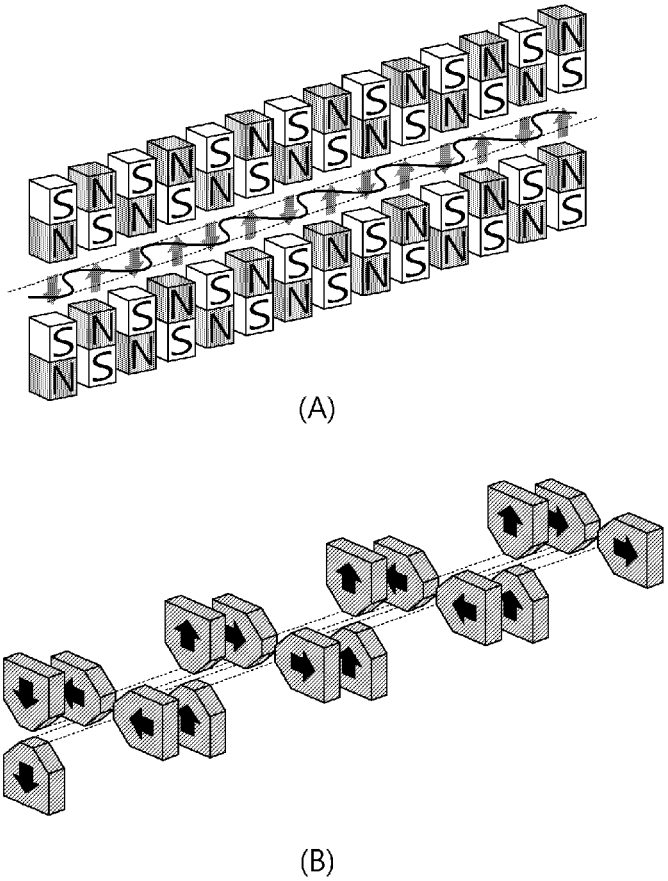
FIG. 1 PRIOR ART
FIG. 1 is a view illustrating a configuration of a general undulator.

100: Variable-period undulator 110: Magnetic part
111: Permanent magnet 112: Ferromagnetic substance
120: Support plate
121: Guide unit through-hole 122: Elastic unit through-hole
130: Guide unit 140: Elastic unit
141: Spring coil 142: Central rod
150: Linear force apply unit 155: Frame
151: Fixed plate 152: Movable plate

MODE FOR CARRYING OUT THE INVENTION

Hereinafter, a variable-period permanent-magnet undulator including the above-described constitutions according to the present invention will be described in detail with reference to the accompanying drawings.

The variable-period undulator according to the present invention fundamentally generates magnetic fields by using a permanent magnet. Thus, the variable-period undulator according to the present invention may generate magnetic fields that are very stable and strong without power consumption when compared to an undulator that generates magnetic fields by using an electromagnet. Also, the variable-period undulator according to the present invention may vary in period of a magnetic field to adjust a wavelength of radiation as well known in its name. Thus, the variable-period undulator according to the present invention may realize the output power of the stable radiation without changing in output power of the radiation and also freely adjust the wavelength of the radiation when compared to the undulator according to the related art.

As described above, in the undulator according to the related art, it is difficult to vary in period of the magnetic field. Also, even though any variable-period structure is disclosed, it is structurally impossible to apply the disclosed variable-period structure to a helical undulator. However, the variable-period undulator according to the present invention may be improved in structure to ultimately solve the above-described problems by easily changing in period even though the permanent magnet is used.

Hereinafter, a principle and constitution of the variable-period undulator according to the present invention will be described in more detail.

Figure 3:
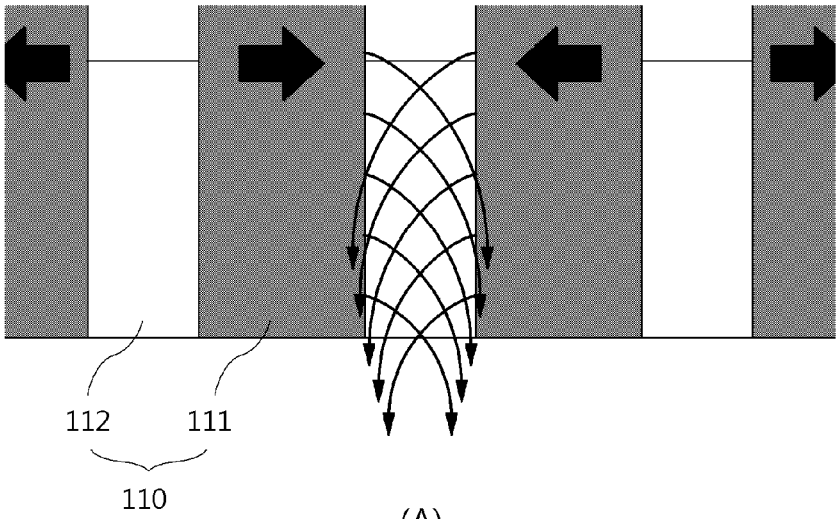
FIG. 3 is a view illustrating a principle of a variable-period undulator according to the present invention.
Figure 3:
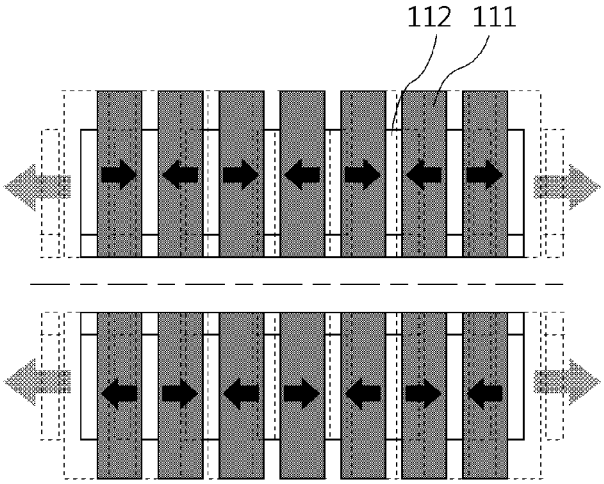

FIG. 3 is a view illustrating a principle of the variable-period undulator according to the present invention. The variable-period undulator according to the present invention, as illustrated in FIG. 3B, includes permanent magnets 111 and ferromagnetic substances 112, which are alternately disposed with respect to each other to form at least a pair of arrays that are spaced apart from each other. Here, the permanent magnet 111 may be magnetized in a direction parallel to the extension direction of each of the arrays of the permanent magnets and the ferromagnetic substances. More particularly, as expressed by left/right arrows on the permanent magnet 111 in FIG. 3B, the pair of permanent magnets 111 adjacent to each other in the extension direction of each of the arrays of the permanent magnets and the ferromagnetic substances are magnetized in directions opposite to each other, and the pair of permanent magnets 111 adjacent to each other in the spaced direction of the arrays of the permanent magnets and the ferromagnetic substances are magnetized in directions opposite to each other. Due to the above-described arrangement, magnetic lines generated from the pair of permanent magnets 111 adjacent to each other may be concentrated into the ferromagnetic substance 112 disposed between the pair of permanent magnets 111 adjacent to each other. Also, as expressed by upward/downward arrows in FIG. 3B, strong magnetic fields are generated between the pair of ferromagnetic substances adjacent to each other in the spaced direction of each of the arrays of the permanent magnets and the ferromagnetic substances.

Here, the undulator 100 according to the present invention may have a very important feature in which the ferromagnetic substance 112 disposed between the pair of permanent magnets 111 is saturated in magnetic flux by the magnetic fields generated by the pair of permanent magnets 111 adjacent to each other. As described above, to saturate the magnetic flux of the ferromagnetic substance 112 disposed between the pair of permanent magnets 111, the permanent magnet 111 has to have a volume much greater than that of the ferromagnetic substance 112. FIG. 3A illustrates an example of a magnetic line in the state where the ferromagnetic substance 112 disposed between the pair of permanent magnets 111 is saturated in magnetic flux.

Figure 2:
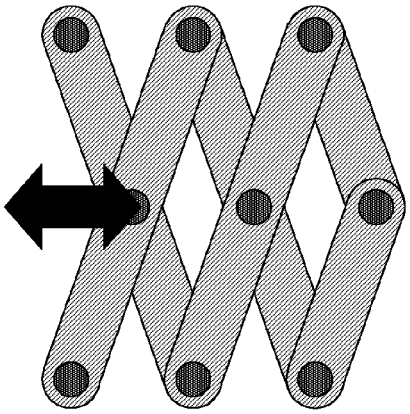
FIG. 2 PRIOR ART
FIG. 2 is a view of a variable-period planar undulator according to a related art.
Figure 2:
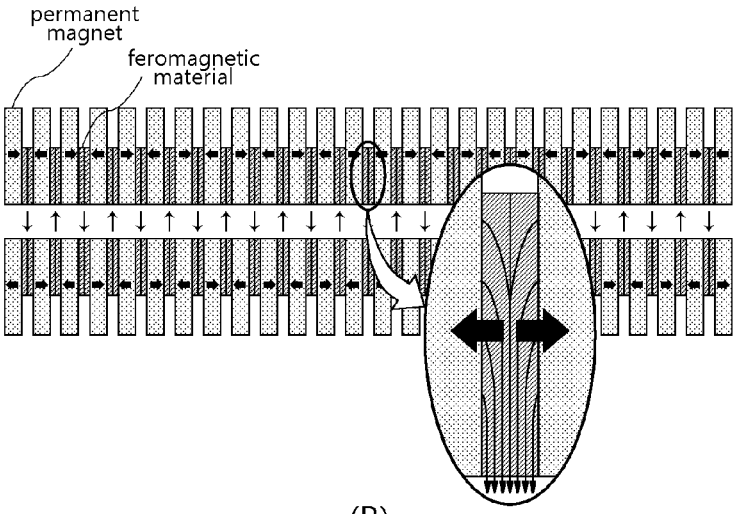
FIG. 2 PRIOR ART

In summary, in case of the prior art 2, as illustrated in the enlarged view of (B) in FIG. 2, the ferromagnetic substance disposed between the permanent magnets is not saturated in magnetic flux, but is disposed to form a symmetrical central line at a central point. Thus, the ferromagnetic substance is separated along the symmetrical central line to generate a repulsive force between the separated ferromagnetic substances. Thus, when the structure according to the prior art 2 is applied to the helical undulator, the permanent magnets disposed on the same plane when the ferromagnetic substance is separated may also be separated from each other. As a result, just when the permanent magnets are separated from each other, since the permanent magnets function as separate permanent magnets, the attractive force may be generated at the separation position. Thus, it may be impossible to adjust a distance between the permanent magnets due to the attractive force between the separated ferromagnetic substances. Therefore, it may be impossible to apply the structure of the prior art 2 to the helical undulator.

However, in the case of the undulator 110 according to the present invention, the ferromagnetic substance 112 may be saturated in magnetic flux to generate a repulsive force between the permanent magnets 111 disposed on both sides of the ferromagnetic substance 112 (unlike the repulsive force between the separated ferromagnetic substances in the prior art 2). As a result, the undulator 100 according to the present invention may vary in distance between the permanent magnet 111 and the ferromagnetic substance 112 by the repulsive force between the permanent magnets 111. That is, as expressed by the dotted lines and the thin arrows displayed on both left and right ends in FIG. 3B, the repulsive force may be generated between the permanent magnets 111 to increase a distance between the permanent magnets 111. If a unit for restraining the movement of the permanent magnet 111 and the ferromagnetic substance 112 is not provided, the ferromagnetic substance 112 may not be saturated in magnetic flux, but be spread in distance up to a position at which the repulsive force between the permanent magnets 111 does not affected with respect to each other. When both ends in the extension direction of the array of the permanent magnet and the ferromagnetic substance are supported, and an adequate compressive force is applied in the extension direction, the permanent magnet 111 and the ferromagnetic substance 112 may be stably positioned in a state where the permanent magnet 111 and the ferromagnetic substance 112 are spread with respect to each other by a desired distance. That is, for no other reason than that only a compressive force apply unit for applying a force in one direction is provided, the distance between the permanent magnet 111 and the ferromagnetic substance 112 may be easily adjusted by the desired degree.

The adjustment in distance between the permanent magnet 111 and the ferromagnetic substance 112 may ultimately represent adjustment in period of the magnetic field of the undulator 100. (Even though will be described later in more detail) The compressive force apply unit for applying the force in the one direction may have a simplified structure that is capable of being very easily manufactured. That is, the compressive force applied in only the one direction by the compressive force apply unit to adjust a distance between components that are disposed in the same one direction. In summary, in case of a complex link structure of the prior art 1 as illustrated in (A) of FIG. 2, so as to adjust a distance between the components, a length of each of links, a relationship between a rotation force at a driving joint and a variation in position of the links, and the like may have to be calculated. Thus, it may be very difficult to form the structure according to the prior art 1 or design the control system of the structure. However, since the undulator 100 according to the present invention has the simplified structure as described above, it may be unnecessary to form the complex line structure or design the difficult control system. Thus, the undulator 100 according to the present invention may be very easily realized in design or control. Particularly, an accurate period error that is required in the variable-period undulator may be in a range of about several hundred micrometers. This value may correspond to a value that is greater by at least about 10 times when compared to the undulator having accuracy of about several ten micrometers or less in the adjustment between the permanent magnets so as to change in the strength of the magnetic field.

That is, according to the present invention, the undulator 100 may very easily vary in period of the magnetic field or be precisely controlled due to the easily design or control thereof. Thus, the radiation generated by the undulator 100 may be freely accurately adjusted in wavelength as one likes. As described above, since the permanent magnet is used as the unit for generating the magnetic field in the undulator 100, the undulator 100 may generate a high output power without power consumption. In addition, since the period of the magnetic field, but the strength of the magnetic field, varies to adjust the wavelength of the radiation in the undulator 100, the output power of the radiation may be stably maintained.

Furthermore, according to the structure of the undulator 100 of the present invention, the structure of the undulator 100 may be freely applied to the helical undulator (that is capable of generating circular polarization radiation) as well as the planar undulator. That is, when the undulator 100 is formed by the pair of arrays of the permanent magnets and the ferromagnetic substances, the undulator 100 may function as the planar undulator. On the other hand, when the undulator 100 is formed by two pairs of arrays of the permanent magnets and the ferromagnetic substances, and the pairs of arrays are disposed perpendicular to each other on the coaxial circle, the undulator 100 may function as the helical undulator. As described above, the structure of the variable-period undulator according to the related art is applied to only the planar undulator, whereas the structure of the undulator 100 according to the present invention may be freely applied to the helical undulator as wall as the planar undulator. Thus, the above-described advantages may be equally applied to the helical undulator.

Figure 4:
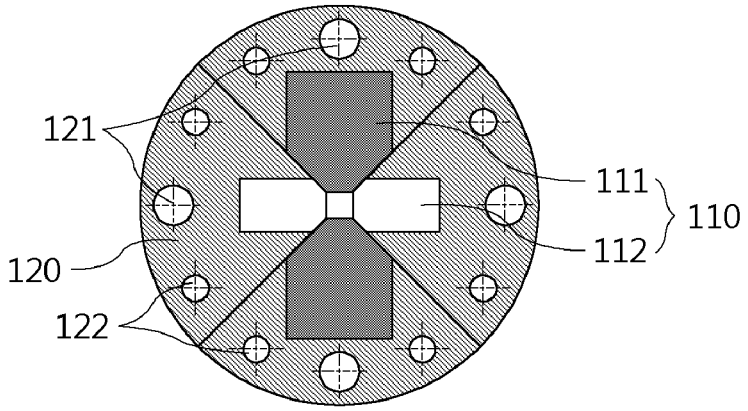
FIGS. 4 and 5 are views of a variable-period undulator according to an embodiment of the present invention.
Figure 4:
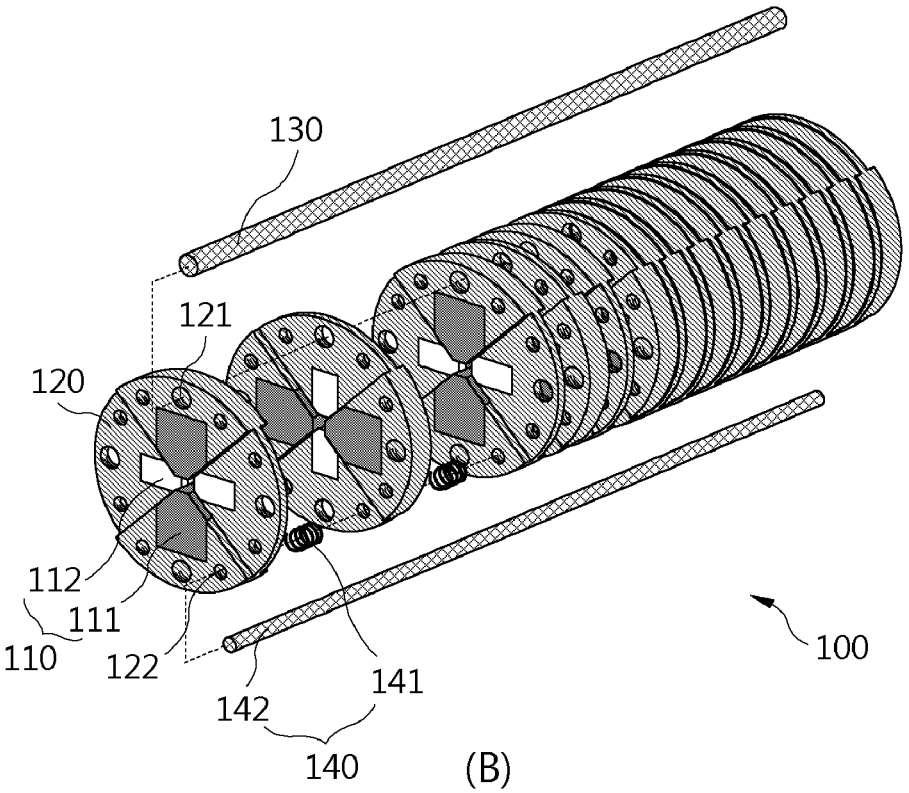
Figure 5:
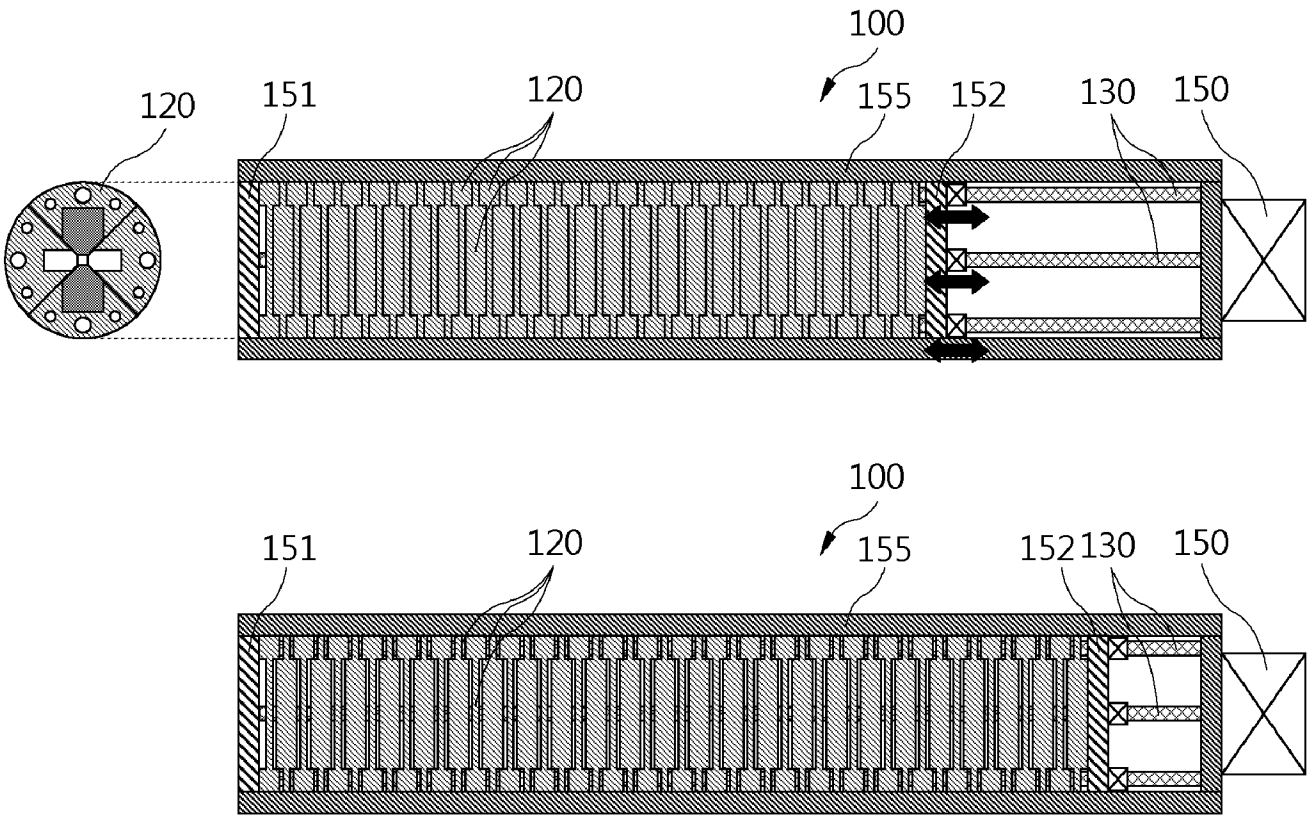
Figure 6:
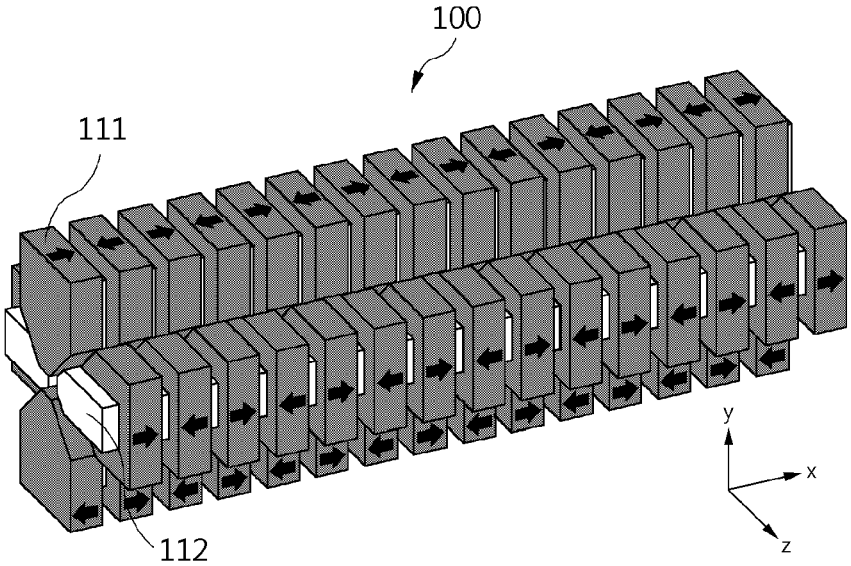
FIGS. 6 to 8 are views illustrating an arrangement structure of a variable-period helical undulator according to the present invention.
Figure 7:
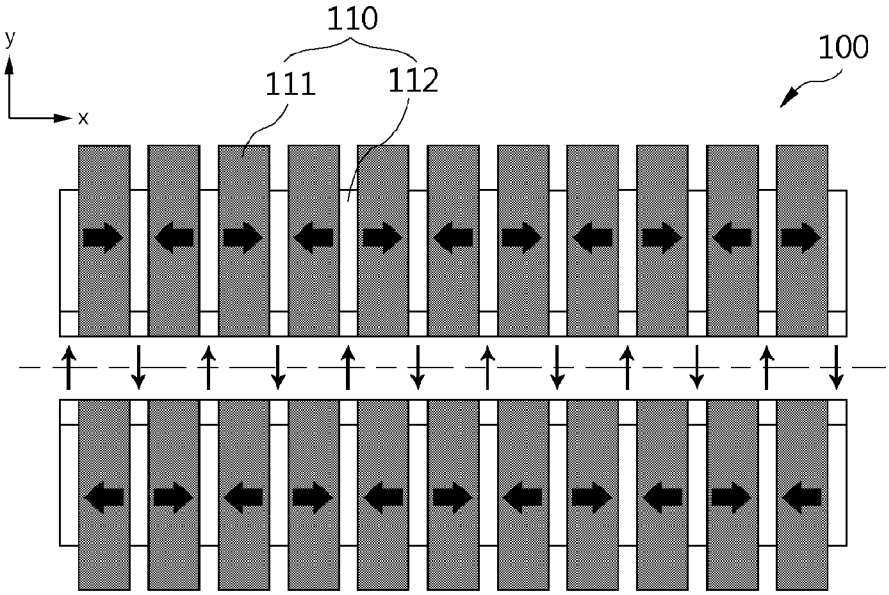
Figure 8:
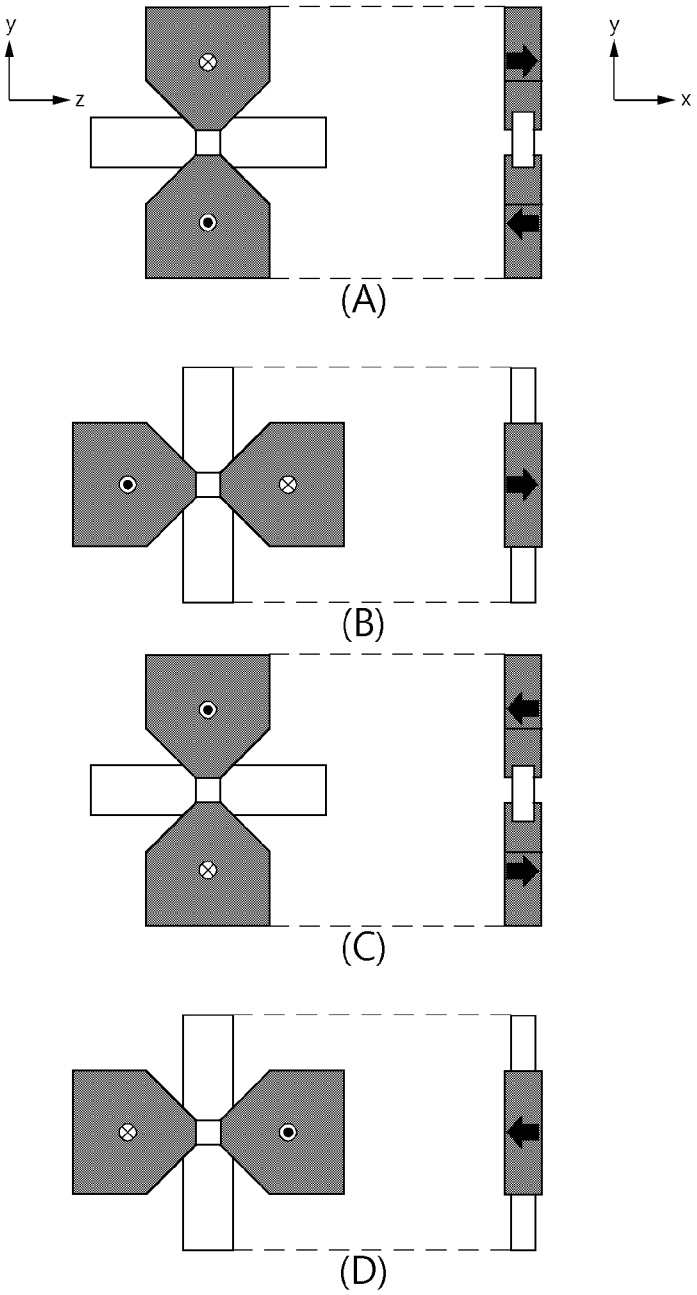
Figure 11:
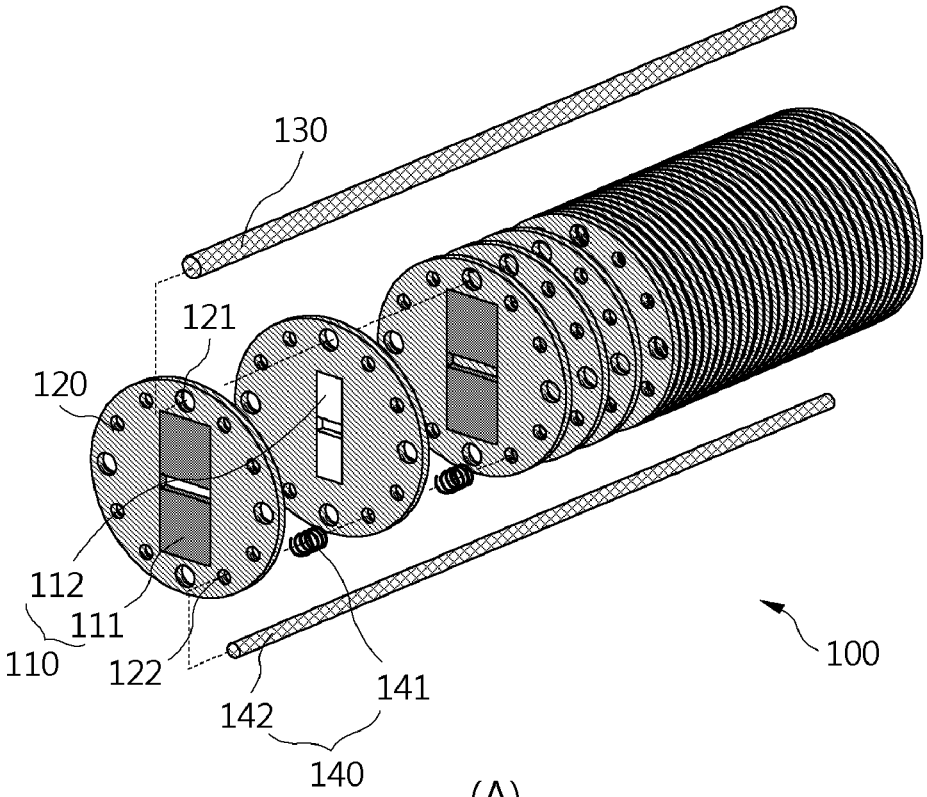
FIG. 11 is a view of a variable-period undulator according to another embodiment of the present invention.
Figure 11:
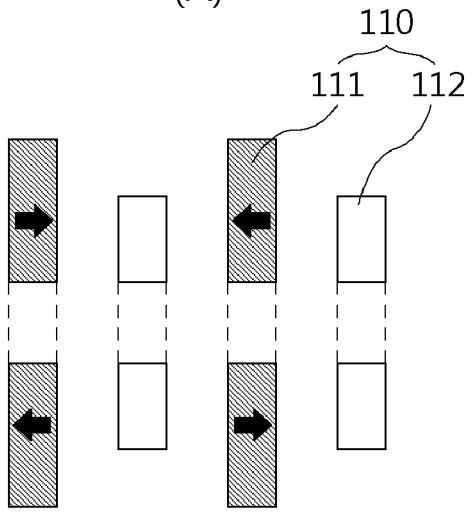

FIGS. 4 and 5 are views of a variable-period undulator according to an embodiment of the present invention, and FIGS. 6 to 8 are views illustrating an arrangement structure of the variable-period undulator according to an embodiment of the present invention, more particularly, views illustrating an example of the undulator 100 that functions as the helical undulator. Also, FIG. 11 is a view of a variable-period undulator according to another embodiment of the present invention, more particularly, a view of an example of the undulator 100 that functions as the variable-period planar undulator. Referring to FIG. 3, the undulator 100 according to the present invention fundamentally includes a permanent magnet 111 and a ferromagnetic substance 112, and substantially, may further include a unit for stably supporting the permanent magnet 111 and the ferromagnetic substance 112 and a compressive force apply unit. FIGS. 4 to 8, and 11 illustrate specific examples of the above-described units.

When undulator 100 functions as the planar undulator (the embodiment in FIG. 11) or the helical undulator (embodiment in FIGS. 4 to 8), the undulator 100 according to the present invention includes a plurality of magnetic parts 110 including at least one of the permanent magnet 111 and the ferromagnetic substance 112, a plurality of support plates 120 for fixedly supporting the magnetic parts 110, a guide unit 130 for guiding linear movement of the support plates 120, and a linear transfer unit 150 for applying a compressive force in an extension direction of an array of the permanent magnet and the ferromagnetic substance. Hereinafter, each part will be described in detail.

Here, for brief description, the terms are defined. Hereinafter, an axial center of the array of the permanent magnet and the ferromagnetic substance is defined as a central point, the extension direction of the array of the permanent magnet and the ferromagnetic substance is defined as a first direction, and two directions perpendicular to the first direction are respectively defined as second and third directions. Referring to FIGS. 6 to 8, the first direction may be defined as an x-axis direction, and the second and third directions may be respectively defined as y-axis and z-axis directions. (Of cause, it may be unnecessary to define the second and third direction as the y-axis and z-axis directions, and thus, the second and third directions may be perpendicular to the first direction and also be perpendicular to each other.)

The magnetic part 110 may be different from each other when the undulator functions as the helical undulator and the planar undulator. When the undulator 100 functions as the helical undulator, the magnetic part 110 may include all of a pair of permanent magnets 111 and a pair of ferromagnetic substances 112. When the undulator 100 functions as the planar undulator, the magnetic part 110 may be provided as two kinds of magnetic parts that are respectively constituted by a permanent magnet magnetic part including only a pair of permanent magnets 111 and a ferromagnetic substance magnetic part including only a pair of ferromagnetic substances 112. The magnetic part 110 will be described in more detail when a magnetized direction of the permanent magnet 111 is described. Furthermore, according to examples of materials for forming the permanent magnet 111 and the ferromagnetic substance 112, the permanent magnet 111 may be formed of a rare-earth-based permanent magnet material and include an Nd—Fe—B permanent magnet or a samarium cobalt-based permanent magnet, and the ferromagnetic substance 112 may be formed of pure steel, low-carbon steel, or vanadium permenduer.

The support plate 120 may be disposed in a direction perpendicular to the first direction to fixedly support the magnetic part 110. Also, the support plate 120 may have a through-hole that defines a passage, through which an electron bean passes, in a central point. The support plate 120 may be formed of a nonmagnetic material to prevent the support plate 120 from being affected by the magnetic part 110 or affecting a direction of a magnetic force. For example, the support plate 120 may be formed of aluminum, an aluminum alloy, copper, or a copper alloy. As shown in the drawings, since the through-hole or a seat part having a groove shape into which the permanent magnet 111 or the ferromagnetic substance 112 are seated is defined in the support plate 120, the magnetic part 110 may be stably fixed and supported. Also, a plurality of guide unit through-holes 121 are defined in the support plate 120.

The guide unit 130 extends parallel to the first direction to pass through each of the guide unit through-holes 121 of the support plate 120. Thus, the guide unit 130 supports the support plate 120 (fixedly supporting the magnetic part 110) and guides a moving trace of the support plate 120 while the support plate 120 linearly moves. The guide unit 130 may be formed of a nonmagnetic material to prevent the support plate 130 from being affected by the magnetic force. For example, the guide unit 130 may also be formed of aluminum, an aluminum alloy, copper, or a copper alloy. Since the plurality of guide unit through-holes 121 are defined in the support plate 120, the guide unit 130 may be provided in plurality. Here, the guide unit through-holes 121 may be symmetrically disposed with respect to the central point to stably support the support plate 120, thereby preventing the array of the permanent magnet and the ferromagnetic substrate from being misaligned. Although four guide units 130 and four guide unit through-holes are provided in FIGS. 4 and 11, the present invention is not limited thereto. Also, a bearing for reducing a friction force against the guide unit 130 may be disposed in the guide unit through-hole 121.

The linear transfer unit 150 may support both ends of the array of the permanent magnet and the ferromagnetic substrate, which are constituted by the magnetic part 110 and the support plate 120, in the first direction to allow a length thereof in the first direction to be variable and may apply a compressive force to the array of the permanent magnet and the ferromagnetic substrate in the first direction to adjust a distance between the magnetic parts 110. When a strong compressive force is applied by the linear transfer unit 150, the distance between the magnetic parts 110 may be narrowed to decrease in period of the magnetic field. On the other hand, when a weak compressive force is applied, the distance between the magnetic parts 110 may be widened to increase in period of the magnetic field. Referring to FIG. 5, the linear transfer unit 150 includes a frame 155, a fixed plate 151 fixed to one end of the array of the permanent magnet and the ferromagnetic substrate of the frame 155, and a movable plate 152 disposed on the other end of the array of the permanent magnet and the ferromagnetic substrate. Thus, the other end of the array of the permanent magnet and the ferromagnetic substrate may be pushed by the movable plate 152 to apply the compressive force. FIG. 5 illustrates an example in which the movable plate 152 linearly moves in the first direction. However, the present invention is not limited to the above-described structure. For example, the linear transfer unit 150 may variously change in structure if the linear transfer unit 150 is transferred in only the first direction.

Furthermore, as illustrated in FIGS. 4 and 11, the undulator 100 according to the present invention may further include a plurality of elastic units 140 disposed between the support plates 120 to generate an elastic force in a direction opposite to that of the compressive force that is applied by the linear transfer unit 150. The elastic unit 140 may generate the elastic force in the direction opposite to that of the compressive force applied by the linear transfer unit 150 to further supplement a repulsive force generated between the magnetic parts 110. Referring to FIGS. 4 and 11, a plurality of elastic unit through-holes 122 may be further defined in the support plate 120. The elastic unit 140 may include a central rod 141 formed of a nonmagnetic material and extending parallel to the first direction to pass through each of the elastic unit through-holes 122 of the plurality of support plates 120 and a spring coil 141 disposed between the support plates 120 and fitted into the central rod. FIGS. 4 and 11 illustrate an example of the elastic unit 140. The central rod 142 may prevent the spring coil 141 from breaking away from a proper position and also function as the guide unit 130. Like the support plate 120 or the guide unit 130, the central rod 142 may also be formed of aluminum, an aluminum alloy, copper, or a copper alloy. As described above, the elastic unit 140 may be disposed so that the elastic unit through-holes 122 are symmetrically disposed with respect to the central point. Although eight elastic units 140 and eight elastic unit through-holes 122 are provided in FIGS. 4 and 11, the present invention is not limited thereto. Also, it may be unnecessary to allow the elastic unit 140 to be constituted by the combination of the central rod and the coil spring. For example, like a structure in which a position breakaway prevention groove is defined in the support plate 120, and the spring is seated into the groove, the elastic unit 140 may variously change in structure if the elastic force for supplementing the repulsive force between the support plates 120 is stably applied to the support plate 120.

When the undulator 100 functions as the helical undulator, a magnetized direction of the permanent magnet 111 will be described in more detail with reference to FIGS. 6 to 8. In FIGS. 6 to 8, for convenience of description, only the permanent magnet 111 and the ferromagnetic substance 112 will be illustrated, and other components will be omitted.

In FIGS. 6 to 8, a first direction is defined as an x-axis direction, a second direction is defined as a y-axis direction, and a third direction is defined as a z-axis direction. As illustrated in FIGS. 6 to 8, when the undulator 100 functions as the helical undulator, the magnetic part 110 includes all of the pair of permanent magnets 111 and the pair of ferromagnetic substances 112. In more detail, the magnetic part 110 includes a pair of permanent magnets 111 disposed symmetrical to each other in a direction perpendicular to the first direction of the central point and magnetized in directions opposite to each other and a pair of ferromagnetic substances 112 disposed symmetrical to each other in a direction perpendicular to the first direction and the arrangement direction of the pair of permanent magnets 111.

When the undulator 100 functions as the helical undulator, four magnetic parts 110 may be provided in one period as described above. Here, if the four magnetic parts 110 are called in order of a first magnetic part 110, a second magnetic part 110, a third magnetic part 110, and a fourth magnetic part 110, the magnetic parts may be arranged as follows. As illustrated in FIGS. 8A and 8B, the second magnetic part 110 may rotate at an angle of about 90° in a predetermined rotation direction with respect to the first magnetic part 110 (here, the rotation direction may be a clockwise or counterclockwise direction, and the clockwise direction is illustrated as an example in FIG. 8) so that the permanent magnet 111 of the first magnetic part 110 and the ferromagnetic substance 112 of the second magnetic part 110 and the ferromagnetic substance 112 of the first magnetic part 110 and the permanent magnet 111 of the second magnetic part 110 face each other. Also, as illustrated in FIGS. 8B and 8C, the third magnetic part 110 may further rotate at an angle of about 90° in the rotation direction with respect to the second magnetic part 110 so that the permanent magnet 111 of the second magnetic part 110 and the ferromagnetic substance 112 of the third magnetic part 110 and the ferromagnetic substance 112 of the second magnetic part 110 and the permanent magnet 111 of the third magnetic part 110 face each other. Also, as illustrated in FIGS. 8C and 8D, the fourth magnetic part 110 may further rotate at an angle of about 90° in the rotation direction with respect to the third magnetic part 110 so that the permanent magnet 111 of the third magnetic part 110 and the ferromagnetic substance 112 of the fourth magnetic part 110 and the ferromagnetic substance 112 of the third magnetic part 110 and the permanent magnet 111 of the fourth magnetic part 110 face each other.

As a result, the permanent magnets of the first to fourth magnetic parts 110 may be magnetized in a direction that successively rotates at an angle of about 90° in the rotation direction. In the x-y plan, as illustrated in FIG. 7, the magnetic fields are alternately formed parallel to a direction in which the ferromagnetic substrates 112 are spaced apart from each other between the ferromagnetic substrates. Of cause, in the x-z plan, the magnetic fields may be equally formed. As a result, the magnetic fields may be formed in four directions that successively rotate at about 90° along the four magnetic parts 110.

Figure 9:
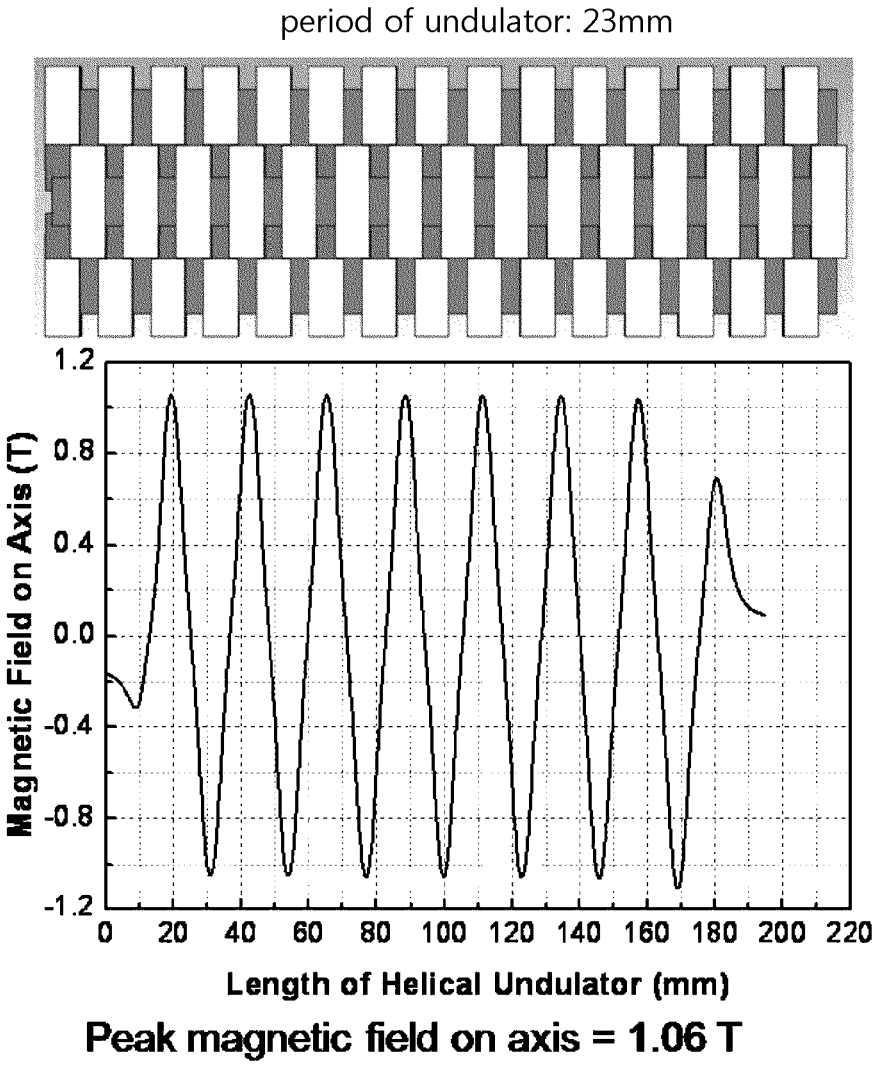
FIGS. 9 and 10 are views illustrating results obtained by a simulation of the variable-period helical undulator according to the present invention.
Figure 10:
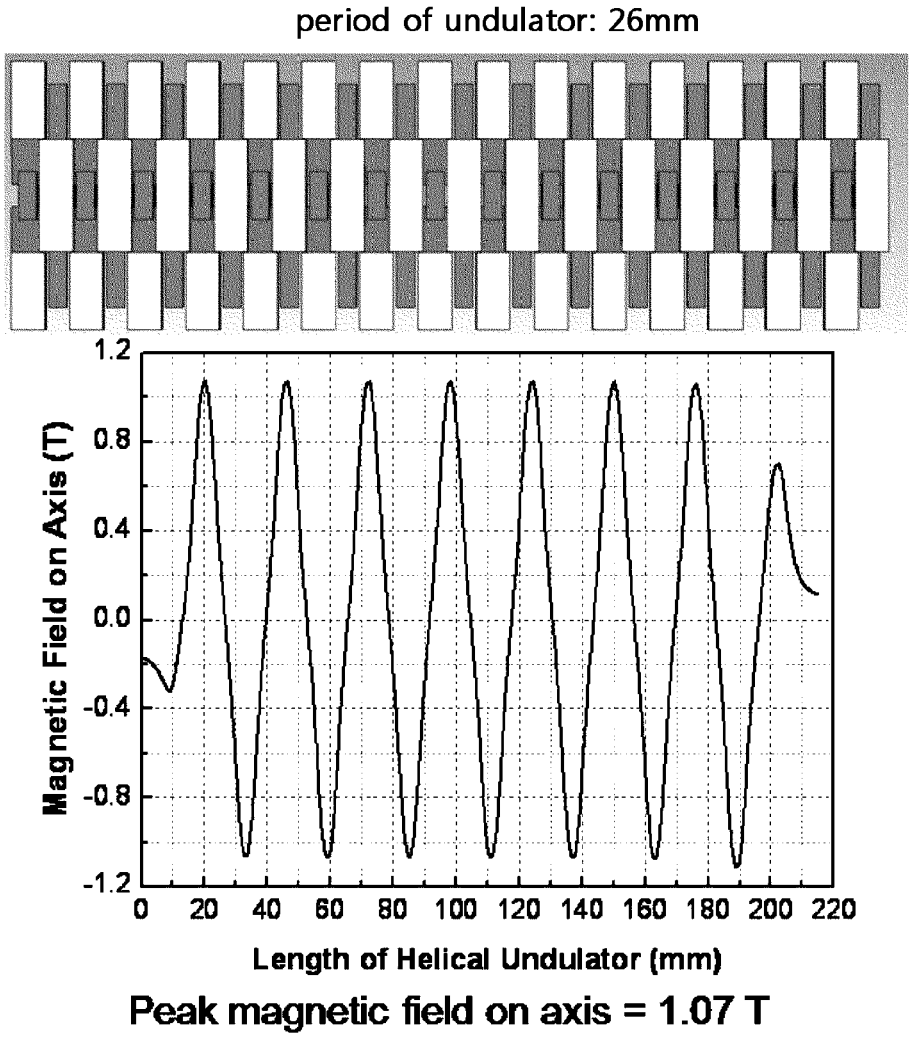

FIGS. 9 and 10 are views illustrating results obtained by a simulation of the variable-period helical undulator according to the present invention. That is, FIGS. 9 and 10 illustrate results obtained by calculating three-dimensional distribution when the undulator varies in period. As described above, since the undulator 100 according to the present invention varies in only period of the magnetic field, the output power of the radiation may not have to change almost even though the magnetic field theoretically varies in period to change in wavelength of the radiation. FIG. 9 illustrates a simulation when the undulator has a period of about 23 mm. Here, a peak value may be about 1.06 T. FIG. 10 illustrates a simulation when the undulator has a period of about 26 mm. Here, a peak value may be about 1.07 T. Thus, it may be seen that the simulated results very accord with predicted values.

When the undulator 100 functions as the planar undulator, a magnetized direction of the permanent magnet 111 will be described in more detail with reference to FIG. 11. In FIG. 11, for convenience of description, only the permanent magnet 111 and the ferromagnetic substance 112 will be illustrated, and other components will be omitted.

As illustrated in FIG. 11, when the undulator 100 functions as the planar undulator, the magnetic part 110 includes two kinds of magnetic parts, i.e., includes only the pair of permanent magnets 111 or only the pair of ferromagnetic substances 112. In more detail, the magnetic part 110 includes two kinds of magnet parts, i.e., a permanent magnet magnetic parts including a pair of permanent magnets that are disposed symmetrical to each other in a direction perpendicular to the first direction of the central point and magnetized in directions opposite to each other and a ferromagnetic substrate magnetic part including a pair of ferromagnetic substances 112 that are disposed parallel to the arrangement direction of the pair of permanent magnets 111 and symmetrical to each other with respect to the central point.

When the undulator 100 functions as the planar undulator, four magnetic parts 110 may be provided in one period as described above. Here, if the four magnetic parts 110 are called in order of a first magnetic part 110, a second magnetic part 110, a third magnetic part 110, and a fourth magnetic part 110, the first and third magnetic parts 110 may function as the permanent magnet magnetic parts, and the second and fourth magnetic parts 110 may function as the ferromagnetic substrate magnetic parts. Also, the permanent magnets 111 of the first and third magnetic parts 110 may be magnetized in directions that are symmetrical to each other.

Thus, as illustrated in FIG. 1A or 2B, the planar undulator in which the magnetic fields are alternately formed in the vertical direction may be easily realized.

The present invention is not limited to the foregoing embodiments, and also it will be understood by those of ordinary skill in the art that various changes in form and details may be made therein without departing from the spirit and scope of the present invention as defined by the following claims.

INDUSTRIAL APPLICABILITY

According to the present invention, the undulator may be adjusted in period, but in strength of the magnetic field, to more stably adjust the wavelength of the radiation. Also, according to the present invention, since the magnetic field is generated by using the permanent magnet, the sufficient strong magnetic field may be generated without the power consumption. Furthermore, according to the present invention, the magnetic field period may very easily vary in the helical undulator. Also, the structure in which the magnetic field period varies may have the simplified structure to significantly reduce a volume of the device in itself. In addition, due to the simplified variable-period structure, the period may be easily and precisely adjusted to precisely adjust the wavelength by the desired degree.

The invention claimed is:

1. A variable-period permanent-magnet undulator comprising:

permanent magnets and ferromagnetic substances, which are alternately arranged to form at least a pair of arrays that are spaced apart from each other, wherein the permanent magnets are magnetized in a direction parallel to an extension direction of each of the arrays of the permanent magnets and the ferromagnetic substances, and each of the ferromagnetic substances disposed between the pair of permanent magnets is saturated in magnetic flux by magnetic fields generated from the pair of permanent magnets adjacent to each other so that a distance between each of the permanent magnets and the ferromagnetic substance varies by a repulsive force between the permanent magnets.

2. The variable-period permanent-magnet undulator of claim 1, wherein the undulator is disposed so that the pair of permanent magnets adjacent to each other in the extension direction of the array of the permanent magnet and the ferromagnetic substance are magnetized in directions opposite to each other, and the pair of permanent magnets adjacent to each other in a spaced direction between the arrays of the permanent magnets and the ferromagnetic substances are magnetized in directions opposite to each other.

3. The variable-period permanent-magnet undulator of claim 1, wherein, in the undulator, the permanent magnet has an area greater than that of the ferromagnetic substance.

4. The variable-period permanent-magnet undulator of claim 1, wherein the undulator comprises a planar undulator constituted by the pair of arrays of the permanent magnets and the ferromagnetic substances or a helical undulator constituted by two pair of arrays of the permanent magnets and the ferromagnetic substances, which are disposed perpendicular to each other on the coaxial circle.

5. The variable-period permanent-magnet undulator of claim 1, wherein the permanent magnet is formed of a rare-earth-based permanent magnet material and comprises an Nd—Fe—B permanent magnet or a samarium cobalt-based permanent magnet.

6. The variable-period permanent-magnet undulator of claim 1, wherein the ferromagnetic substance is formed of at least one material selected from pure steel, low-carbon steel, and vanadium permenduer.

7. The variable-period permanent-magnet undulator of claim 1, wherein, when an axial center of the array of the permanent magnet and the ferromagnetic substance is defined as a central point, the extension direction of the array of the permanent magnet and the ferromagnetic substance is defined as a first direction, and two directions perpendicular to the first direction are respectively defined as second and third directions, the undulator comprises:

a plurality of magnetic parts comprising at least one of the pair of permanent magnets and the pair of ferromagnetic substances;

a plurality of support plates disposed in a direction perpendicular to the first direction to fixedly support the magnetic parts, the plurality of support plates having a through-hole that defines a passage, through which electron beams pass, in the central point and a plurality of guide unit through-holes and being formed of a nonmagnetic material;

a plurality of guide units extending in a direction parallel to the first direction to pass through the guide unit through-holes of the plurality of support plates, the plurality of guide units being formed of a nonmagnetic material; and a linear transfer unit supporting both ends of the array of the permanent magnet and the ferromagnetic substance, which is constituted by the magnetic parts and the support plates, in the first direction, the linear transfer unit having a length that varies in the first direction and applying a compressive force to the permanent magnet and the ferromagnetic substance in the first direction to adjust a distance between the magnets.

8. The variable-period permanent-magnet undulator of claim 7, wherein, in the undulator, the magnetic parts comprise a pair of permanent magnets that are disposed symmetrical to each other in a direction perpendicular to the first direction of the central point and are magnetized in directions opposite to each other and a pair of ferromagnetic substances that are disposed symmetrical to each other in a direction perpendicular to the first direction and the arrangement direction of the pair of permanent magnets of the central point, four magnetic parts are disposed in one period to form a helical undulator, when the four magnetic parts are successively defined as a first magnetic part, a second magnetic part, a third magnetic part, and a fourth magnetic part, the second magnetic part rotates at an angle of about 90° in a predetermined rotation direction with respect to the first magnetic part so that the permanent magnet of the first magnetic part and the ferromagnetic substance of the second magnetic part and the ferromagnetic substance of the first magnetic part and the permanent magnet of the second magnetic part face each other, the third magnetic part further rotates at an angle of about 90° in the rotation direction with respect to the second magnetic part so that the permanent magnet of the second magnetic part and the ferromagnetic substance of the third magnetic part and the ferromagnetic substance of the second magnetic part and the permanent magnet of the third magnetic part face each other, the fourth magnetic part further rotates at an angle of about 90° in the rotation direction with respect to the third magnetic part so that the permanent magnet of the third magnetic part and the ferromagnetic substance of the fourth magnetic part and the ferromagnetic substance of the third magnetic part and the permanent magnet of the fourth magnetic part face each other, and the permanent magnets of the first to fourth magnetic parts are magnetized in a direction that successively rotates at an angle of about 90° in the rotation direction.

9. The variable-period permanent-magnet undulator of claim 8, wherein the rotation direction is a clockwise direction or counterclockwise direction using the first direction of an axis.

10. The variable-period permanent-magnet undulator of claim 7, wherein, in the undulator, the magnetic parts comprise two kinds of parts comprising a pair of permanent magnets that are disposed symmetrical to each other in a direction perpendicular to the first direction of the central point and are magnetized in directions opposite to each other and a pair of ferromagnetic substances that are disposed symmetrical to each other in a direction parallel to the arrangement direction of the pair of permanent magnets of the central point, four magnetic parts are disposed in one period to form a helical undulator, when the four magnetic parts are successively defined as a first magnetic part, a second magnetic part, a third magnetic part, and a fourth magnetic part, the first and third magnetic parts correspond to permanent magnet magnetic parts, and the second and fourth magnetic parts correspond to ferromagnetic substance magnetic parts, and the permanent magnets of the first and third magnetic parts are magnetized in opposite directions that are symmetrical to each other.

11. The variable-period permanent-magnet undulator of claim 7, wherein the linear transfer unit comprises:

a frame;

a fixed plate fixed to one end of the array of the permanent magnet and the ferromagnetic substance of the frame; and a movable plate disposed on the other end of the array of the permanent magnet and the ferromagnetic substance, wherein the other end of the array of the permanent magnet and the ferromagnetic substance is pushed by the movable plate to apply the compressive force, and the movable linearly moves in the first direction.

12. The variable-period permanent-magnet undulator of claim 7, wherein each of the support plates is formed of a material selected from aluminum, an aluminum alloy, copper, and a copper alloy.

13. The variable-period permanent-magnet undulator of claim 7, wherein each of the guide units is formed of a material selected from aluminum, an aluminum alloy, copper, and a copper alloy.

14. The variable-period permanent-magnet undulator of claim 7, wherein the guide unit through-holes are disposed symmetrical to each other of the central point.

15. The variable-period permanent-magnet undulator of claim 7, wherein a bearing for reducing a friction force against each of the guide units is disposed in each of the guide unit through-holes.

16. The variable-period permanent-magnet undulator of claim 7, wherein the undulator further comprises a plurality of elastic units disposed between the support plates to generate an elastic force in a direction opposite to the compressive force that is applied by the linear transfer unit.

17. The variable-period permanent-magnet undulator of claim 16, wherein, in the undulator, a plurality of elastic unit through-holes are further defined in the support plates, wherein each of the elastic units comprises a central rod formed of a nonmagnetic material and extending parallel to the first direction to pass through each of the elastic unit through-holes of the plurality of support plates and a spring coil disposed between the support plates and fitted into the central rod.

18. The variable-period permanent-magnet undulator of claim 17, wherein the central rod is formed of a material selected from aluminum, an aluminum alloy, copper, and a copper alloy.

19. The variable-period permanent-magnet undulator of claim 16, wherein the elastic unit through-holes are symmetrically disposed with respect to the central point.

* * * * *